United States Patent [19]

Lamborn

[11] 4,282,789

[45] Aug. 11, 1981

[54] FINGER MOUNTABLE ELECTRIC GUITAR PICK-UP

[76] Inventor: Steven H. Lamborn, 3217 S. 368th Pl., Federal Way, Wash. 98003

[21] Appl. No.: 820,778

[22] Filed: Aug. 1, 1977

[51] Int. Cl.[3] ..... G10H 3/00

[52] U.S. Cl. ..... 84/1.15; 84/116

[58] Field of Search ..... 84/1.09, 1.1, 1.14, 84/1.16, 1.24, 1.27, 319; 179/1 M, 115.5 R, 121 C, 141, 153

[56] References Cited

U.S. PATENT DOCUMENTS

| | | | |
|---|---|---|---|
| 2,229,189 | 1/1941 | Rice | 84/1.16 |
| 2,392,937 | 1/1946 | McDaniel | 84/1.16 |
| 2,500,172 | 3/1950 | Gillenwater | 84/1.01 |
| 2,725,778 | 12/1955 | Cronwell | 84/1.16 |
| 3,194,104 | 7/1965 | Rhodes et al. | 84/319 |
| 3,290,425 | 12/1966 | Stobaugh | 84/1.16 |
| 3,516,151 | 6/1970 | Schneider | 179/115.5 R |
| 3,519,721 | 7/1970 | Martin et al. | 84/1.14 |
| 3,530,228 | 9/1970 | Scherer | 84/1.16 |
| 3,725,561 | 4/1973 | Paul | 84/1.15 |
| 3,741,065 | 6/1973 | Harris | 84/319 |
| 3,854,368 | 12/1974 | Pogan | 84/319 |
| 4,098,946 | 6/1978 | Clough, Jr. | 84/319 |
| 4,171,659 | 10/1979 | Tumminaro | 84/1.16 |

*Primary Examiner*—Vit W. Miska

*Attorney, Agent, or Firm*—Klarquist, Sparkman, Campbell, Leigh, Whinston and Dellett

[57] ABSTRACT

A device mountable on a guitarist's finger for use in altering the normal vibration of a vibrating guitar string and for converting the altered vibrations into electrical impulses is disclosed. The device includes a generally cylindrical string contacting member on which is mounted a microphone-type transducer.

1 Claim, 9 Drawing Figures

FIG. 1
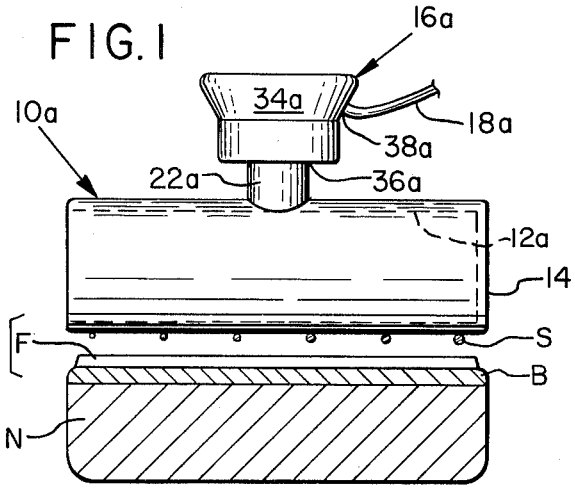
FIG. 2
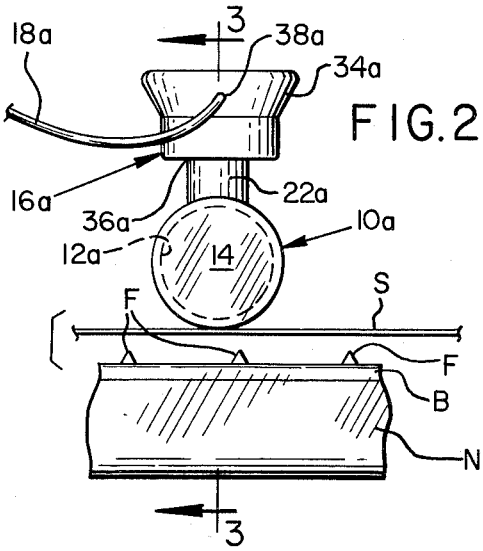
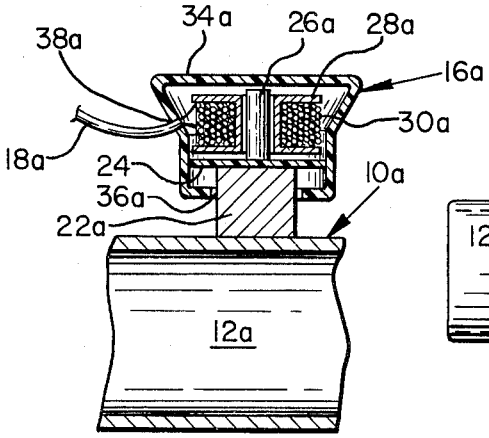
FIG. 3
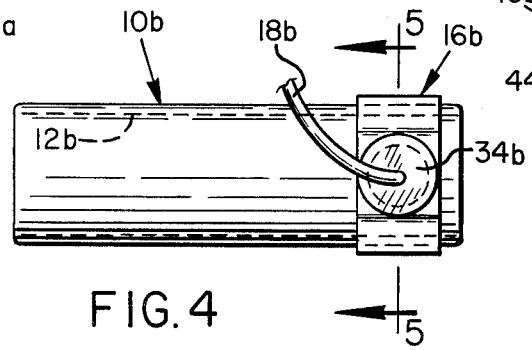
FIG. 4
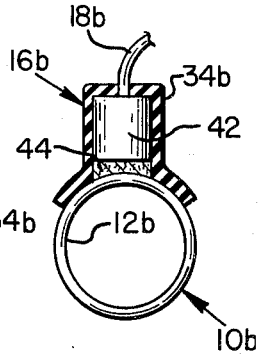
FIG. 5
FIG. 6
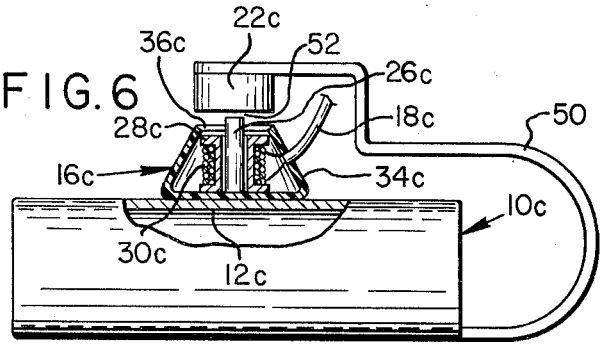
FIG. 7
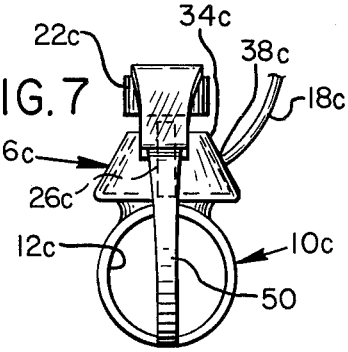
FIG. 8
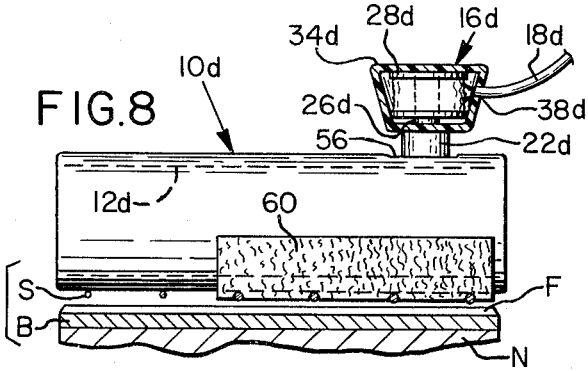
FIG. 9
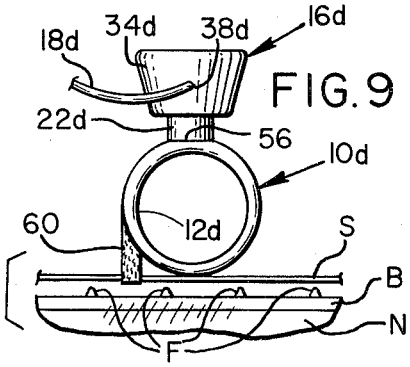

FINGER MOUNTABLE ELECTRIC GUITAR PICK-UP

BACKGROUND OF THE INVENTION

The present invention relates to appliances for use with electrical guitars and more specifically relates to electric guitar sound pick-up devices.

In recent years, a variety of electrical and mechanical devices have been devised to modify or enhance the sound produced by musical string instruments, especially guitars. In almost every instance, however, the guitar's vibrations are initially converted to electrical impulses by one or more pick-ups located on the instrument's body near the bridge.

Also, it is known to provide guitar slide bars for use in forming chords. Devices of this type are shown in U.S. Pat. Nos. 3,741,065 to Harris, and 3,854,368 to Pogan. A brief history of such devices is provided in the first two columns of the Pogan patent.

SUMMARY OF THE INVENTION

It has now been discovered that a new tone quality can be obtained from an electric guitar if it is played with a slide bar and the vibrations of the slide bar converted into electrical signals which are amplified and broadcast through loud speakers.

BRIEF DESCRIPTION OF THE DRAWINGS

In the drawings:

FIG. 1 is a side view of a pick-up apparatus according to the present invention in playing position adjacent the neck of a guitar;

FIG. 2 is an end view of the apparatus shown in FIG. 1;

FIG. 3 is a partial, sectional view taken along line 3—3 of FIG. 2;

FIG. 4 is a top view of a second embodiment of the present invention;

FIG. 5 is a sectional view taken along line 5—5 of FIG. 4;

FIG. 6 is a side view of a third embodiment of the present invention with portions of the microphone element shown in cross-section;

FIG. 7 is an end view of the apparatus shown in FIG. 6;

FIG. 8 is a side view of a fourth embodiment of the present invention in playing position adjacent the neck of a guitar; and, FIG. 9 is an end view of the apparatus shown in FIG. 8.

DESCRIPTION OF THE PREFERRED EMBODIMENT

FIGS. 1 through 3 illustrate the most basic embodiment of the present invention. A tubular string contacting member 10*a* has a circular, cylindrical, inner surface 12*a* which defines a finger receiving opening and may, optionally, be closed at one end by an end plate 14. Mounted on the outer surface of the member 10*a* is a microphone 16*a* which is connected to an amplifier by means of a two-strand cable 18*a*.

Interior details of the microphone, appearing in FIG. 3, include a permanent magnet 22*a*, a non-magnetic spacer 24 of plastic or the like, and an iron core 26*a*, which extends outwardly from the spacer 24. A plastic spool 28*a* surrounds the core 26*a* and a coil of wire 30*a* is positioned upon the spool. Each end of the coil is connected to one of the two strands of cable 18*a*. These microphone components are totally enclosed within a plastic casing 34*a*, except a first opening 36*a* receives the magnet 22*a*, and a second opening 38*a* admits the cable 18*a*. The magnet 22*a* is adhesively secured to the string contacting member and the casing 34*a* so that these three elements form an integral unit.

The second embodiment (FIGS. 4 and 5) is somewhat similar, but differs in that it includes a miniature condenser microphone element 42 of the type commonly used in portable tape recorders, instead of the coil and magnet arrangement previously described. A layer of deadening material 44, such as felt, is provided between the microphone 42 and a metal contacting member 10*b*. A rubber outer casing 34*b* snugly contains the microphone 42 and is glued directly to the contacting member.

A third embodiment, shown in FIGS. 6 and 7, includes the same type of microphone element shown in FIG. 3. In this instance, however, a layer of a casing 34*c* is adhesively secured to the contacting member 10*c* to separate the core 26*c* from the contacting member; and the casing 34*c* has an opening 36*c* which faces away from the contacting member 10*c*. An arm 50 extends from one end of the contacting member 10*c* and mounts a permanent magnet 22*c* a short distance above the armature 26*c* such that there is a small air space 52 between the magnet and the outermost end of the core.

The fourth embodiment is shown in FIGS. 8 and 9 to include a coil and magnet-type microphone. This embodiment differs from those previously described in that the microphone casing 34*d* is entirely enclosed except for a small opening 38*d* to admit the cable 18*d*. The core 26*d* and spool 28*d* are both located within the casing 34*d*; and the permanent magnet 22*d* is adhesively secured between the casing and the contacting member 10*d*.

In this fourth embodiment the contacting member 10*d* is made of glass whereas the previously described embodiments included metal contacting members. A flattened area 56 may conveniently be provided on one surface of the member 10*d* to form a seat 40 for adhesive attachment of the magnet 22*d*.

The apparatus shown in FIGS. 8 and 9 further includes a felt damper 60 which is positioned on the contacting member in such a location that when the contacting member is in contact with the instrument's strings, the damper contacts at least some of the strings to damp the vibrations of the string portions which extend between the contacting member 10*d* and the guitar's nut (not shown).

OPERATION

The operation of each of the above embodiments is best understood by referring to FIGS. 1, 8 and 9 which show the first and fourth embodiments in playing position relative to the neck N of a guitar. The illustrated neck has those elements common to most guitars including a fret board B on the upper surface of the neck N, and frets F extending outwardly from the fret board B. Strings S are suspended above the frets F.

A right-handed guitarist would hold the string contacting member 10 against the strings of the guitar with his left hand while using his right hand to strum or pluck the strings. Most conveniently, the guitarist may slide the fourth finger of his left hand into the opening defined by the inner surface 12 and hold the contacting member against the strings by placing the thumb of his left hand against the neck of the guitar and then squeezing his left thumb and forefinger together in a jaw-like manner.

When the guitarist picks or strums the strings with his right hand, vibrations are transmitted to the contacting member 10 and thereby to the microphone 16. The microphone converts the vibrations into electrical impulses which are amplified and then converted into sound waves by loud speakers.

Vibrations produce electrical impulses in the microphones of the first, third and fourth embodiments because a permanent magnet vibrates relative to the spool, coil and core elements of the microphone. This vibration causes voltages proportional to the vibration velocity to be induced in the coil.

The coloration of sound which results when electrical impulses from this novel pick-up are amplified and applied to loudspeakers differs from the sound coloration obtained from standard guitar pick-ups, and a variety of special effects can thus be achieved. For example, the electrical impulses from the pick-up of the present invention may be amplified and converted without modification into sound waves by a loudspeaker. They may be mixed with the electrical impulses from a standard guitar pick-up on the same instrument. Or, electrical signals from the novel pick-up and signals from a standard guitar pick-up on the same instrument can simultaneously be amplified in separate systems and broadcast from separate loudspeakers positioned at different locations. Also, the electrical signal produced by the novel pick-up can be modified by any of the prior art devices used for this purpose.

The pick-up of the present invention is successful in obtaining a "new sound" quality because there is a mechanical contact directly between the microphone elements and the guitar strings whereas an air gap exists between the guitar strings and conventional pick-ups. Conventional pick-ups thus detect only vibrations transmitted by moving air and/or by the guitar's body. Also, conventional guitar pick-ups are located at a point between the ends of a length of guitar string which is free to vibrate. Direct contact by a conventional pick-up would thus alter the pitch of the string, by changing its effective length. By placing the pick-up on a contacting member which defines one end of a vibrating string, direct mechanical contact is possible without a reduction in clarity or an alteration of pitch.

The unique sound produced by the finger mountable pick-up is further the result of the pick-up's use adjacent the instrument's neck N. The neck of a guitar typically is less resonant than the same instrument's body and thus adds less of an overtone pattern to the string's natural vibrations.

It has also been found that the construction of the pick-up according to the present invention has a substantial effect on the coloration of the sound produced. Structural factors which influence the sound include the composition of the string contacting member, e.g. a metal contacting member produces a different sound than a glass contacting member.

The type of microphone further affects the sound, and the presence of deadening material such as the material 44 (FIG. 5) will affect the volume and tinniness of the sound. A damper of the type shown at 60 (FIG. 9) will reduce overtones introduced by vibrations of the string portions which extend from the contacting member 10 to the instrument's nut. The configuration and size of the contacting member 10 will affect its resonance, and thus change the sound. For example, the arm 50 of the third embodiment (FIGS. 6 and 7) will vibrate like a tine of a tuning fork to add a pulsating overtone to the sound.

While I have shown and described preferred embodiments of my invention, it will be apparent to those skilled in the art that changes and modifications may be made without departing from my invention in its broadest aspects. For example, the contacting member could comprise a solid rod instead of a tube or could otherwise be modified in shape, configuration or composition.

I claim:

1. A guitar pick-up apparatus comprising:

string contacting means for contacting a guitar string to alter the vibrational frequency thereof; and a transducer mechanically connected to said string contacting means for producing electrical impulses which correspond to the vibrations of said string when said contacting means is in contact with said string, said transducer including:

a. an elongated iron core radiating outwardly from said contacting means;

b. an electrically conducting coil surrounding said core;

c. an arm extending from said contacting means to a position just outward of said core;

d. a permanent magnet positioned on said arm so that it is located adjacent to, but out of contact with the outermost end of said core; and e. mounting means to hold said coil and core to said contacting means in such a fashion that said magnet is free to move relative to said coil so that, when said contacting means is held against a vibrating guitar string, said contacting means vibrates and said magnet moves relative to said coil so that the reluctance of the magnetic circuit is varied and an output voltage, proportional to the vibration velocity, is produced in said coil.

* * * * *